US010469935B2

(12) United States Patent
Kunimoto et al.

(10) Patent No.: US 10,469,935 B2
(45) Date of Patent: Nov. 5, 2019

(54) BONE CONDUCTION SPEAKER AND BONE CONDUCTION HEADPHONE DEVICE

(71) Applicant: Panasonic Corporation, Osaka (JP)

(72) Inventors: Hiroshi Kunimoto, Osaka (JP); Yushi Ogino, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 332 days.

(21) Appl. No.: 14/023,648

(22) Filed: Sep. 11, 2013

(65) Prior Publication Data

US 2014/0185837 A1 Jul. 3, 2014

Related U.S. Application Data

(63) Continuation of application No. PCT/JP2013/003380, filed on May 29, 2013.

(30) Foreign Application Priority Data

Dec. 28, 2012 (JP) ..... 2012-287105

(51) Int. Cl.
*H04R 25/00* (2006.01)
*H04R 1/10* (2006.01)
*H04R 5/033* (2006.01)

(52) U.S. Cl.
CPC ..... *H04R 1/1075* (2013.01); *H04R 5/0335* (2013.01); *H04R 2400/03* (2013.01); *H04R 2400/07* (2013.01); *H04R 2460/13* (2013.01)

(58) Field of Classification Search
CPC ..... H04R 1/105; H04R 1/46; H04R 1/1075; H04R 2460/13
(Continued)

(56) References Cited

U.S. PATENT DOCUMENTS 4,354,067 A * 10/1982 Yamada ..... A61H 23/0236 381/301
6,483,917 B1 * 11/2002 Kang ..... H04M 1/05 379/430
(Continued)

FOREIGN PATENT DOCUMENTS

GB 443692 A * 3/1936
JP 63-131480 U 8/1988
(Continued)

OTHER PUBLICATIONS

International Search Report for corresponding International Application No. PCT/JP2013/003380, dated Jul. 3, 2014.

*Primary Examiner* — Phylesha Dabney
(74) *Attorney, Agent, or Firm* — Renner, Otto, Boisselle & Sklar, LLP

(57) ABSTRACT

When sound signals are input to a vibration driver through signal wires, the vibration driver converts the sound signals into mechanical vibrations. A second elastic member transmits the mechanical vibrations of the vibration driver to a user. On the other hand, air vibrations are generated by the vibration driver in a space formed by the vibration driver and a first elastic member. The air vibrations are converted into mechanical vibrations by the first elastic member, and are transmitted to the second elastic member. The second elastic member also transmits the mechanical vibrations transmitted from the first elastic member, to the user.

9 Claims, 10 Drawing Sheets

(58) Field of Classification Search
USPC ..... 381/151, 380, 370, 324, 378, 385; 340/407.1
See application file for complete search history.

(56) References Cited

U.S. PATENT DOCUMENTS

| | | | | |
|---|---|---|---|---|
| 8,345,915 | B2 * | 1/2013 | Shin et al. | 381/396 |
| 2002/0085733 | A1 | 7/2002 | Cottrell | |
| 2006/0262954 | A1 * | 11/2006 | Lee | H04M 1/03 381/380 |
| 2009/0285417 | A1 | 11/2009 | Shin et al. | |
| 2010/0201501 | A1 * | 8/2010 | Ueda | B06B 1/045 340/407.1 |
| 2010/0316235 | A1 * | 12/2010 | Park | H04R 1/025 381/151 |
| 2011/0255732 | A1 * | 10/2011 | Kwon | H04R 9/06 381/396 |

FOREIGN PATENT DOCUMENTS

| | | | | |
|---|---|---|---|---|
| JP | 2006-501756 | A | 1/2006 | |
| JP | 2009-543421 | A | 12/2009 | |
| JP | 2011-130334 | A | 6/2011 | |
| WO | WO2008/004718 | A1 * | 1/2008 | H04R 9/00 |

* cited by examiner

BONE CONDUCTION SPEAKER AND BONE CONDUCTION HEADPHONE DEVICE

CROSS-REFERENCE TO RELATED APPLICATIONS

This is a continuation of International Application No. PCT/JP2013/003380 filed on May 29, 2013, which claims priority to Japanese Patent Application No. 2012-287105 filed on Dec. 28, 2012. The entire disclosures of these applications are incorporated by reference herein.

BACKGROUND

The present disclosure relates to bone conduction speakers and bone conduction headphone devices.

Japanese Patent Publication No. 2011-130334 discloses a bone conduction speaker and a bone conduction headphone device including a primary vibration transmitter which is placed on the side head of a user and transmits mechanical vibrations to the skull of the user, and an auxiliary vibration transmitter which is placed on the tragus of the user and transmits the mechanical vibrations to the tragus cartilage. The user can get deep bass sound without closing his or her ears.

SUMMARY

The present disclosure is intended to provide a bone conduction speaker and a bone conduction headphone device with improved quality of high frequency sound and reduced sound leakage to the surroundings.

A bone conduction speaker and a bone conduction headphone device of the present disclosure includes: a vibration driver which generates mechanical vibrations and air vibrations from sound signals; a first elastic member which converts the air vibrations generated by the vibration driver into mechanical vibrations; and a second elastic member which is positioned to touch the vibration driver and transmits the mechanical vibrations generated by the vibration driver and the mechanical vibrations transmitted from the first elastic member, to a user.

The bone conduction speaker and the bone conduction headphone device of the present disclosure advantageously improve quality of high frequency sound and reduce sound leakage to the surroundings.

DETAILED DESCRIPTION

Embodiments will be described in detail below, with reference to the drawings. Unnecessarily detailed description may be omitted. For example, detailed description of well-known techniques or description of substantially the same elements may be omitted. Such omission is intended to prevent the following description from being unnecessarily redundant and to help those skilled in the art easily understand it.

Inventors provide the following description and the attached drawings to enable those skilled in the art to fully understand the present disclosure. Thus, the description and the drawings are not intended to limit the scope of the subject matter defined in the claims.

First Embodiment

The first embodiment will be described with reference to FIG. 1 to FIG. 11.

[1-1. Configurations]

[1-1-1. Configuration of Bone Conduction Headphone Device]

Figure 1:
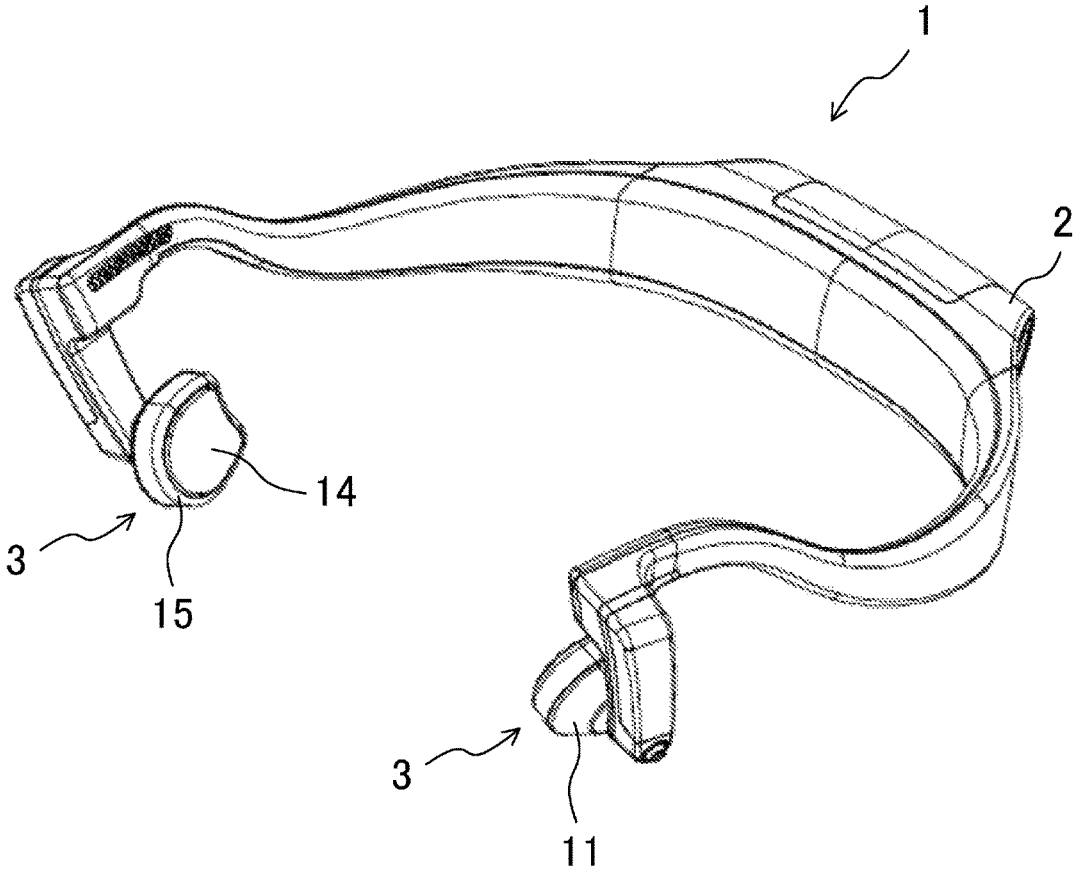
FIG. 1 is an oblique view illustrating an appearance of a bone conduction headphone device according to the first embodiment.

FIG. 1 is an oblique view illustrating the appearance of a bone conduction headphone device according to the first embodiment. The bone conduction headphone device 1 of FIG. 1 includes a band 2 and bone conduction speakers 3 positioned at both ends of the band 2. The band 2 is made of a moderately elastic material that is worn around the back of the user's head or the neck, e.g., synthetic resin such as polypropylene, or is made of an approximately U-shaped metal, such as aluminum and stainless.

[1-1-2. Configuration of Bone Conduction Speaker]

Figure 2:
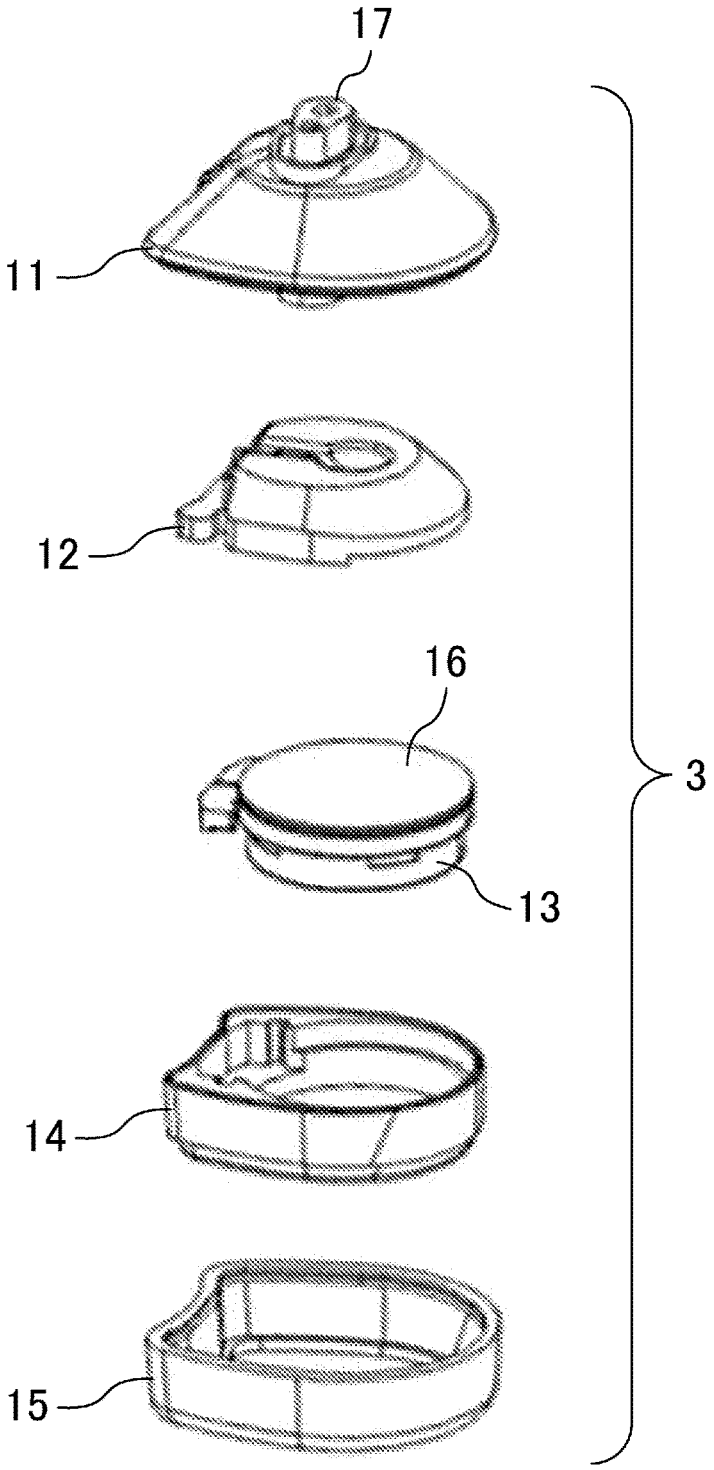
FIG. 2 is an exploded oblique view illustrating inner configurations of the bone conduction speaker shown in FIG. 1

FIG. 2 is an exploded oblique view illustrating inner configurations of the bone conduction speaker shown in FIG. 1. The bone conduction speaker 3 includes a vibration driver 13 whose opening is closed by a vibration plate 16. The bone conduction speaker 3 is covered with a first elastic member 12 and a second elastic member 14, and is placed in a first housing 15 and closed by a second housing 11 having a hole 17 through which signal wires (not shown) pass. As illustrated in FIG. 1, the second elastic member 14 is exposed from the opening of the first housing 15 so that the second elastic member 14 can be placed on the side head of the user.

Figure 3:
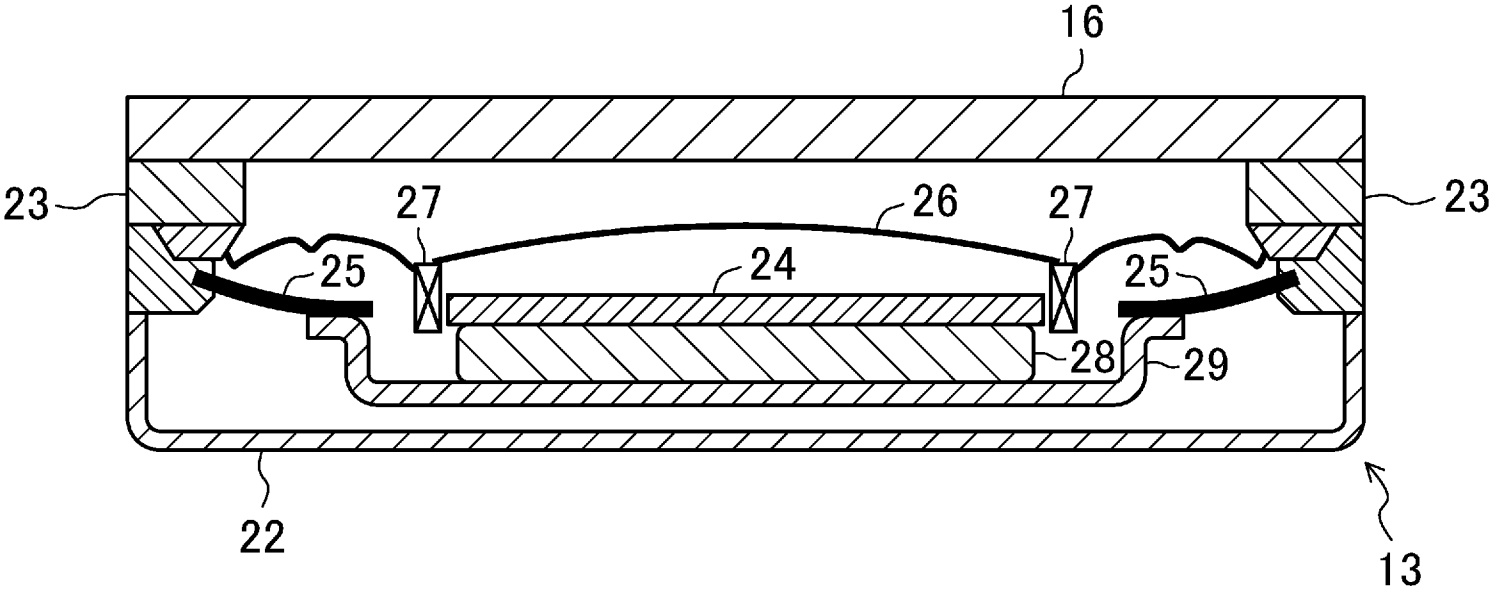
FIG. 3 is an enlarged cross sectional view illustrating detailed configurations of a vibration driver and a vibration plate shown in FIG. 2.

FIG. 3 is an enlarged cross sectional view illustrating detailed configurations of the vibration driver 13 and the vibration plate 16 shown in FIG. 2. The vibration driver 13 is of an electromagnetic type which is configured to convert sound signals into mechanical vibrations, and includes: a coil 27 to which the sound signals transmitted through the signal wires (not shown) are transmitted; a magnet 24 which vibrates up and down according to change in magnetic field caused by the coil 27; a weight 28 which adds weight to the magnet 24; a yoke 29 connected to the weight 28; a spring 25 which holds the magnet 24 and the weight 28 via the yoke 29; a diaphragm 26 which vibrates up and down together with the coil 27, due to magnetic effects of the coil 27 with respect to the magnet 24; and a housing 22 which accommodates the magnet 24, the spring 25, the diaphragm 26, the coil 27, the weight 28 and the yoke 29, and transmits the mechanical vibrations of the magnet 24 to the outside via the spring 25. Similar to the magnet 24, the weight 28 and the yoke 29 are made of electromagnetic soft iron, for example.

The vibration driver 13 has an opening on the front side near the diaphragm 26, and the vibration plate 16 is arranged so as to close the opening. The vibration plate 16 converts air vibrations generated by the diaphragm 26 and traveling to the opening, into mechanical vibrations. In the present embodiment, the vibration plate 16 is made of an acrylic board. Further, in the example shown in FIG. 3, an annular spacer 23 is interposed between the vibration driver 13 and the vibration plate 16 to prevent the up and down vibrating diaphragm 26 from touching the vibration plate 16.

Figure 4:
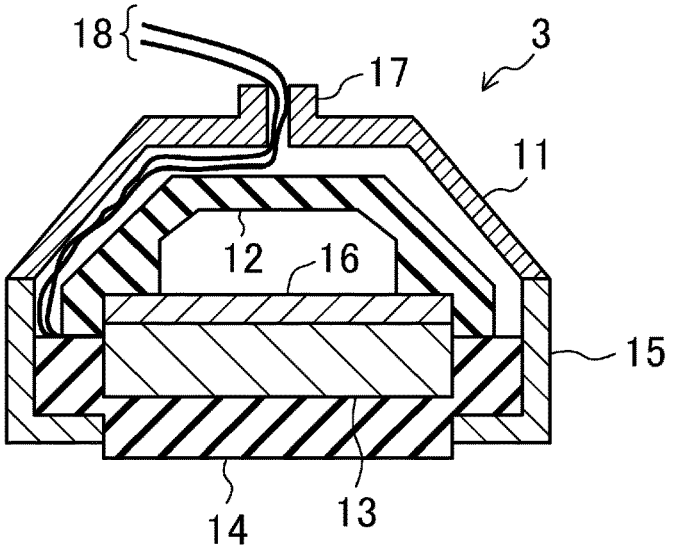
FIG. 4 is a cross sectional view illustrating inner configurations of the bone conduction speaker shown in FIG. 1.

FIG. 4 is a cross sectional view illustrating inner configurations of the bone conduction speaker 3 shown in FIG. 1. The first housing 15 and the second housing 11 are made of synthetic resin, for example. The second housing 11 is provided with the hole 17 for drawing two signal wires 18 provided inside the band 2 into the second housing 11. The signal wires 18 are connected to the vibration driver 13.

The first elastic member 12 is arranged such that it forms a space above the vibration driver 13, and touches the second elastic member 14. The first elastic member 12 is made of a moderately elastic material, such as rubber. The side surface of the first elastic member 12 may touch the second housing 11.

The second elastic member 14 is arranged such that it touches a lower portion of the vibration driver 13, and is exposed from the opening of the first housing 15. The second elastic member 14 is made of a moderately elastic material, such as rubber. In the bone conduction speaker 3 of FIG. 4, the side surface of the second elastic member 14 touches the first housing 15, but a gap may be present between the first housing 15 and the second elastic member 14.

[1-2. Working Mechanism]

[1-2-1. State of Usage of Bone Conduction Headphone Device]

Figure 5:
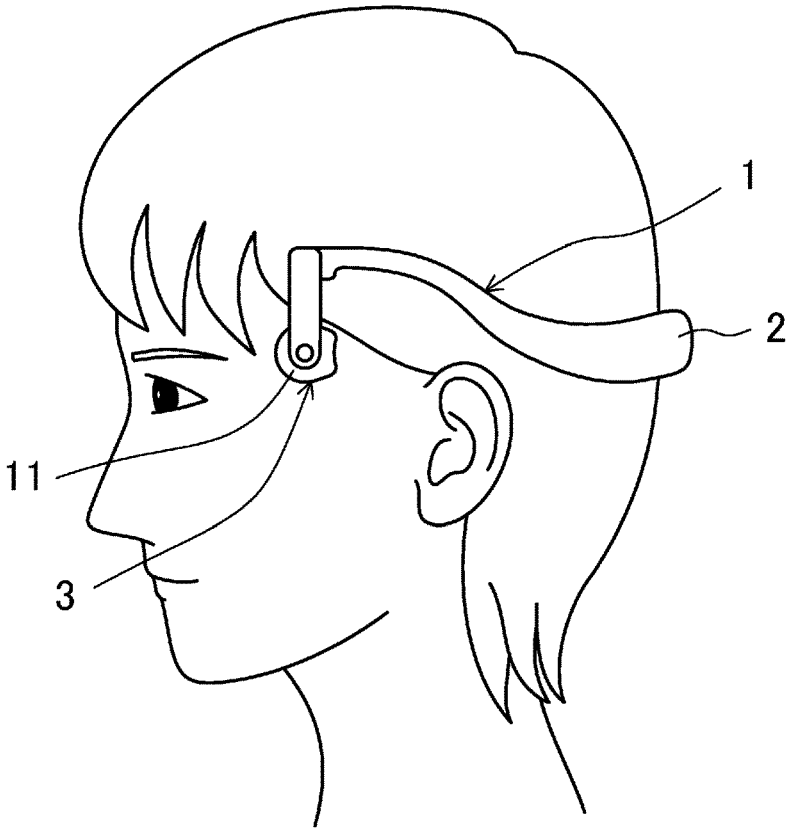
FIG. 5 illustrates a state of usage of the bone conduction headphone device of FIG. 1.

FIG. 5 illustrates a state of usage of the bone conduction headphone device 1 of FIG. 1. The user wears the bone conduction headphone device 1 such that the bone conduction speaker 3 is placed on the side head.

[1-2-2. Functions of Vibration Driver and Vibration Plate in Bone Conduction Speaker]

Figure 6:
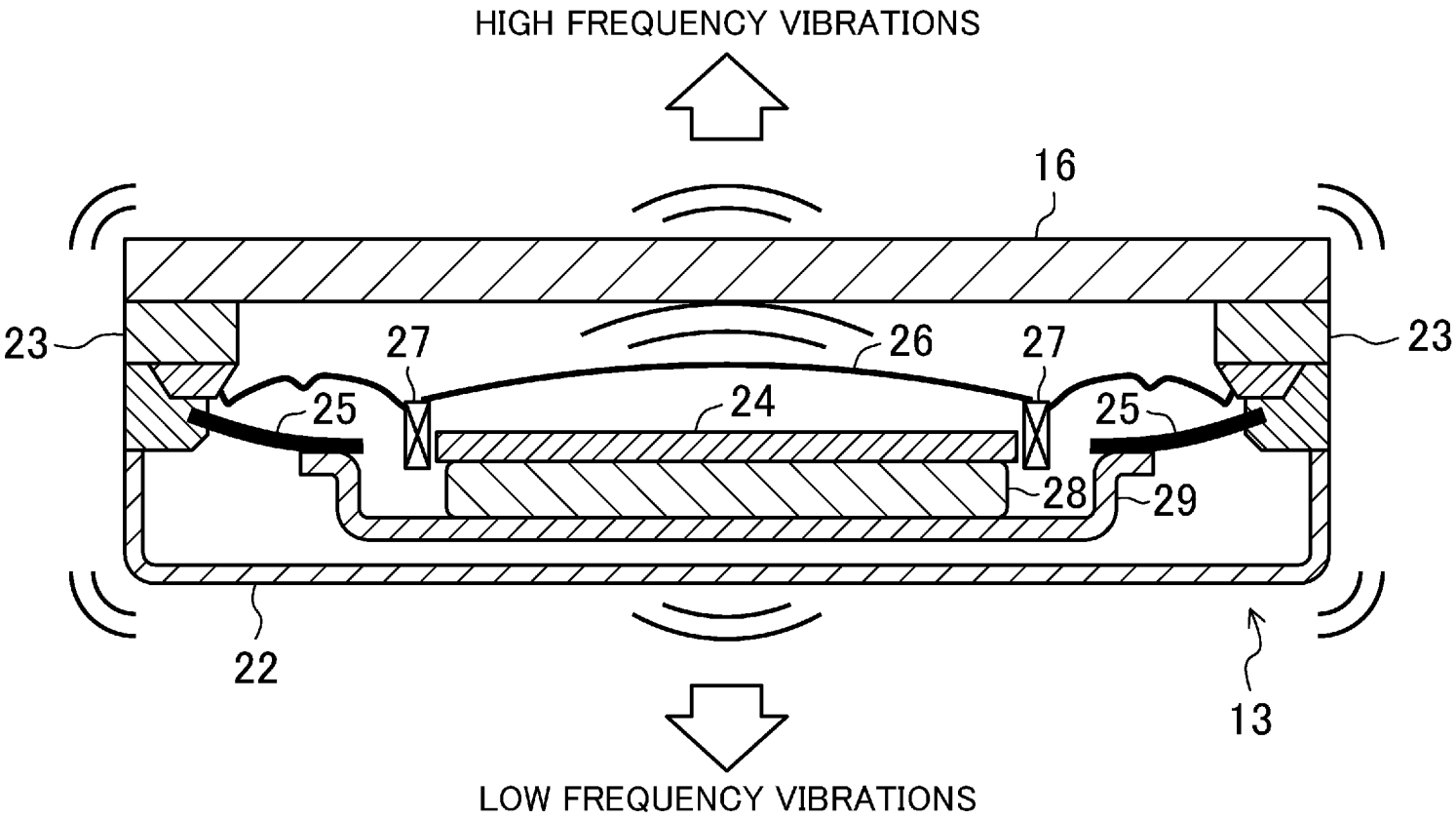
FIG. 6 illustrates how the vibration driver and the vibration plate shown in FIG. 3 work.

FIG. 6 illustrates how the vibration driver 13 and the vibration plate 16 shown in FIG. 3 work. When sound signals are transmitted to the coil 27, the magnet 24 vibrates up and down together with the weight 28 and the yoke 29. The diaphragm 26 vibrates up and down together with the coil 27 with respect to the magnet 24. The vibration plate 16 converts air vibrations generated by the up and down vibrations of the diaphragm 26 into mechanical vibrations, and transmits the mechanical vibrations to the outside as high frequency vibrations. On the other hand, the housing 22 transmits the mechanical vibrations transmitted from the magnet 24 via the spring 25, to the outside as low frequency vibrations.

In the bone conduction speaker 3 of FIG. 4, the high frequency vibrations of the vibration plate 16 are transmitted to the second elastic member 14 via the first elastic member 12 and the second housing 11. The second elastic member 14 transmits the low frequency vibrations transmitted from the magnet 24 and the high frequency vibrations transmitted from the vibration plate 16, to the user.

[1-2-3. Functions of First and Second Elastic Members in Bone Conduction Speaker]

Figure 7:
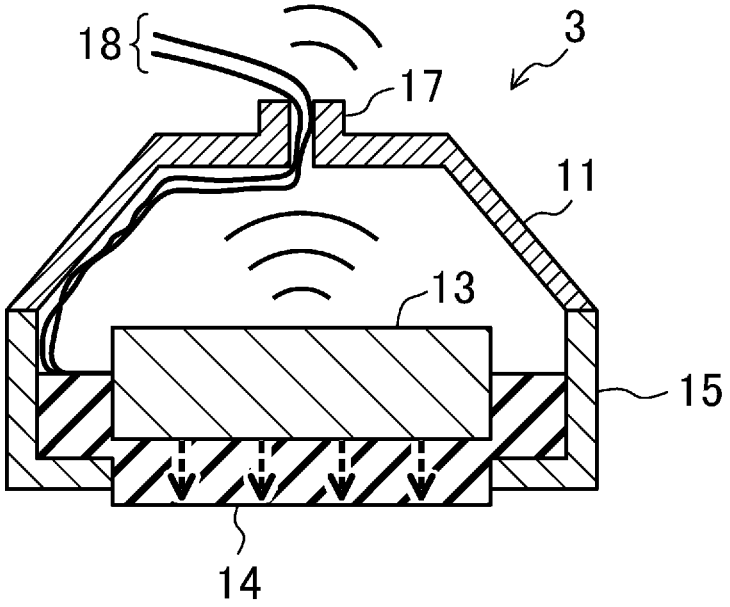
FIG. 7 illustrates how a bone conduction speaker according to a comparative example works.

FIG. 7 illustrates how a bone conduction speaker 3 according to a comparative example works. The bone conduction speaker of the comparative example does not include the first elastic member 12 and the vibration plate 16. In addition, a gap is present in the hole 17 through which the signal wires 18 are drawn into the second housing 11. Thus, when the vibration driver 13 converts sound signals input via the signal wires 18 into mechanical vibrations, air vibrations caused in the inner space of the bone conduction speaker 3 by the vibrations of the vibration driver 13 are released outside through the hole 17, which may result in an increase in leakage sound.

Figure 8:
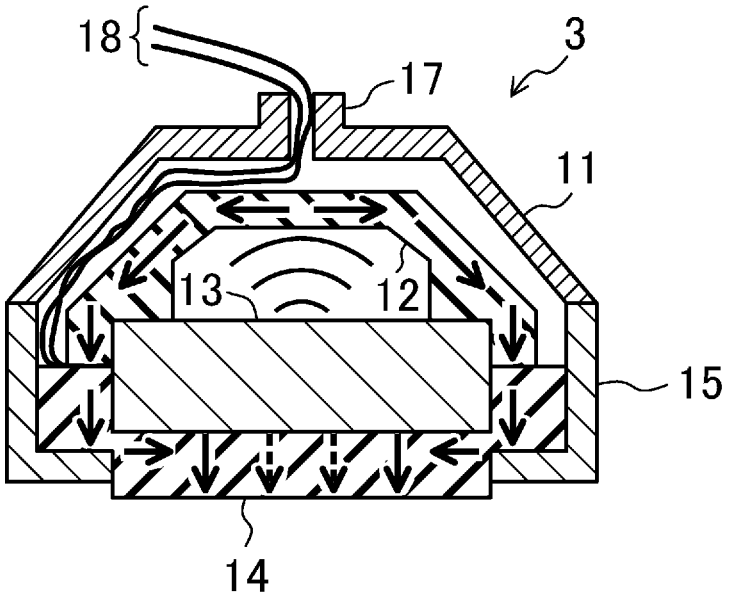
FIG. 8 illustrates how a bone conduction speaker without a vibration plate according to a variation works.

FIG. 8 illustrates how a bone conduction speaker 3 without the vibration plate 16 according to a variation works. In this case, the vibration driver 13 converts input sound signals into mechanical vibrations. The second elastic member 14 transmits the mechanical vibrations of the vibration driver 13 to the user. Air vibrations are caused in the space formed by the vibration driver 13 and the first elastic member 12, by the vibrations of the vibration driver 13. These air vibrations are converted to mechanical vibrations by the first elastic member 12, and are transmitted to the second elastic member 14. The second elastic member 14 also transmits the mechanical vibrations transmitted from the first elastic member 12, to the user. The bone conduction speaker 3 with the vibration plate 16 as shown in FIG. 4 may also have an advantage that the air vibrations leaked from the vibration driver 13 can be converted into mechanical vibrations by the first elastic member 12.

To prevent sound leakage caused by vibrations of the signal wires 18, the signal wires 18 may preferably be sandwiched between the first elastic member 12 and the second elastic member 14 as shown in FIG. 4 and FIG. 8.

[1-3. Effects, Etc.]

Figure 9:
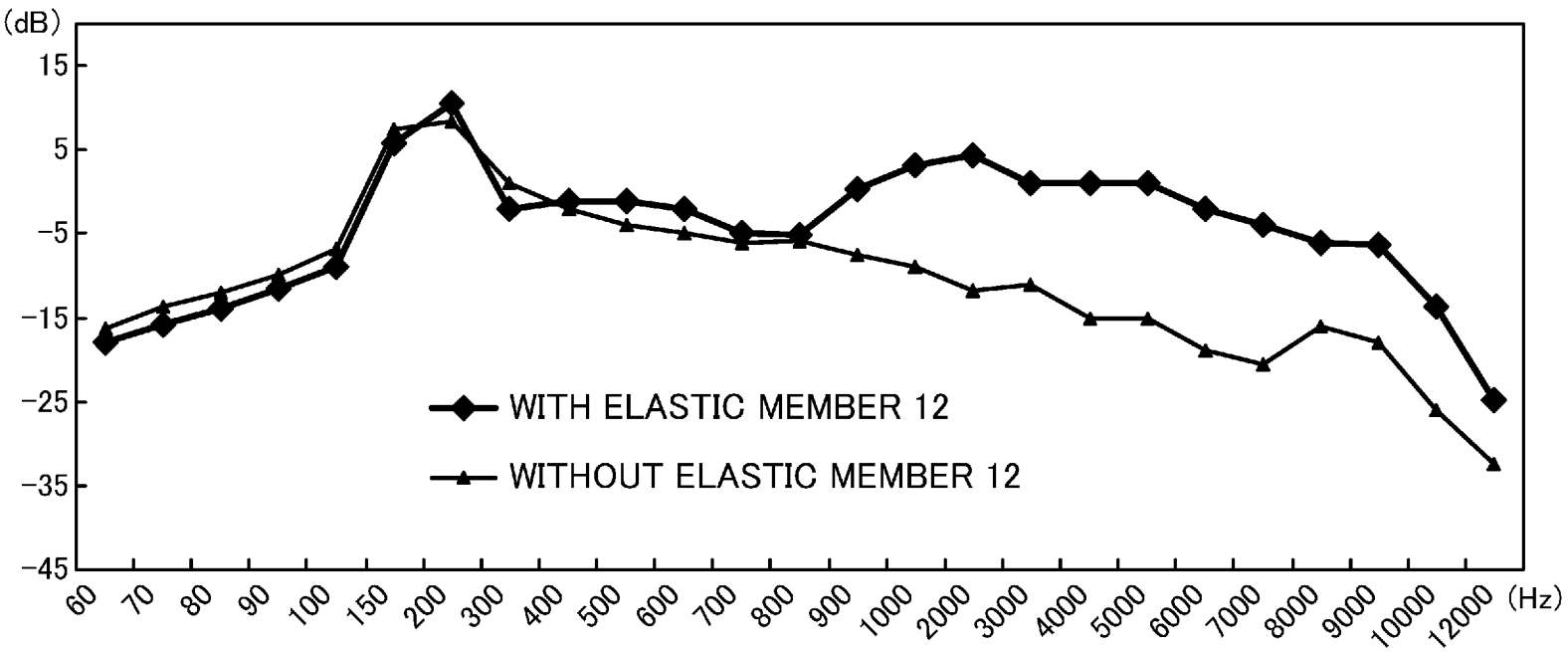
FIG. 9 shows frequency characteristics of output vibration strength of the bone conduction speaker shown in FIG. 8 in both cases where the first elastic member is and is not provided.

FIG. 9 shows frequency characteristics of output vibration strength of the bone conduction speaker 3 shown in FIG. 8 in both cases where the first elastic member 12 is provided and where the first elastic member 12 is not provided (see FIG. 7). In FIG. 9, the vertical axis represents a sound pressure (dB), and the horizontal axis represents a frequency of vibration (Hz). As shown in FIG. 9, the bone conduction speaker 3 with the first elastic member 12 shown in FIG. 8 provides higher sound pressure in the midrange and high frequencies, i.e., 1000 Hz or higher, than the bone conduction speaker of the comparative example without the first elastic member 12. In other words, quality of sound in the midrange and high frequencies is clear.

Figure 10:
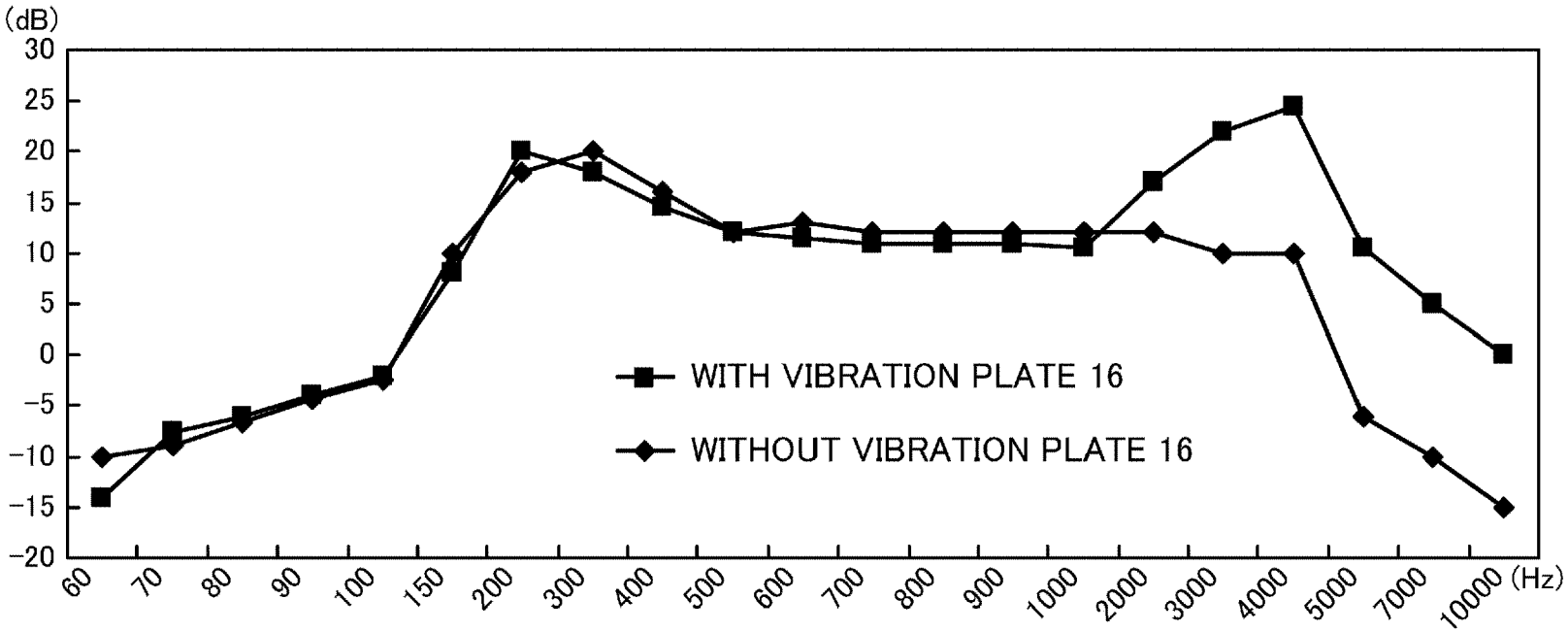
FIG. 10 shows frequency characteristics of output vibration strength of the bone conduction speaker shown in FIG. 4 in both cases where the vibration plate is and is not provided.

FIG. 10 shows frequency characteristics of output vibration strength of the bone conduction speaker 3 shown in FIG. 4 in both cases where the vibration plate 16 is provided and where the vibration plate 16 is not provided. In FIG. 10, the vertical axis represents a sound pressure (dB), and the horizontal axis represents a frequency of vibration (Hz). As shown in FIG. 10, the bone conduction speaker 3 with the vibration plate 16 shown in FIG. 4 provides higher sound pressure in the high frequencies, i.e., 4000 Hz or higher, than a bone conduction speaker of the comparative example without the vibration plate 16. In other words, quality of sound in the high frequencies is clear.

Figure 11:
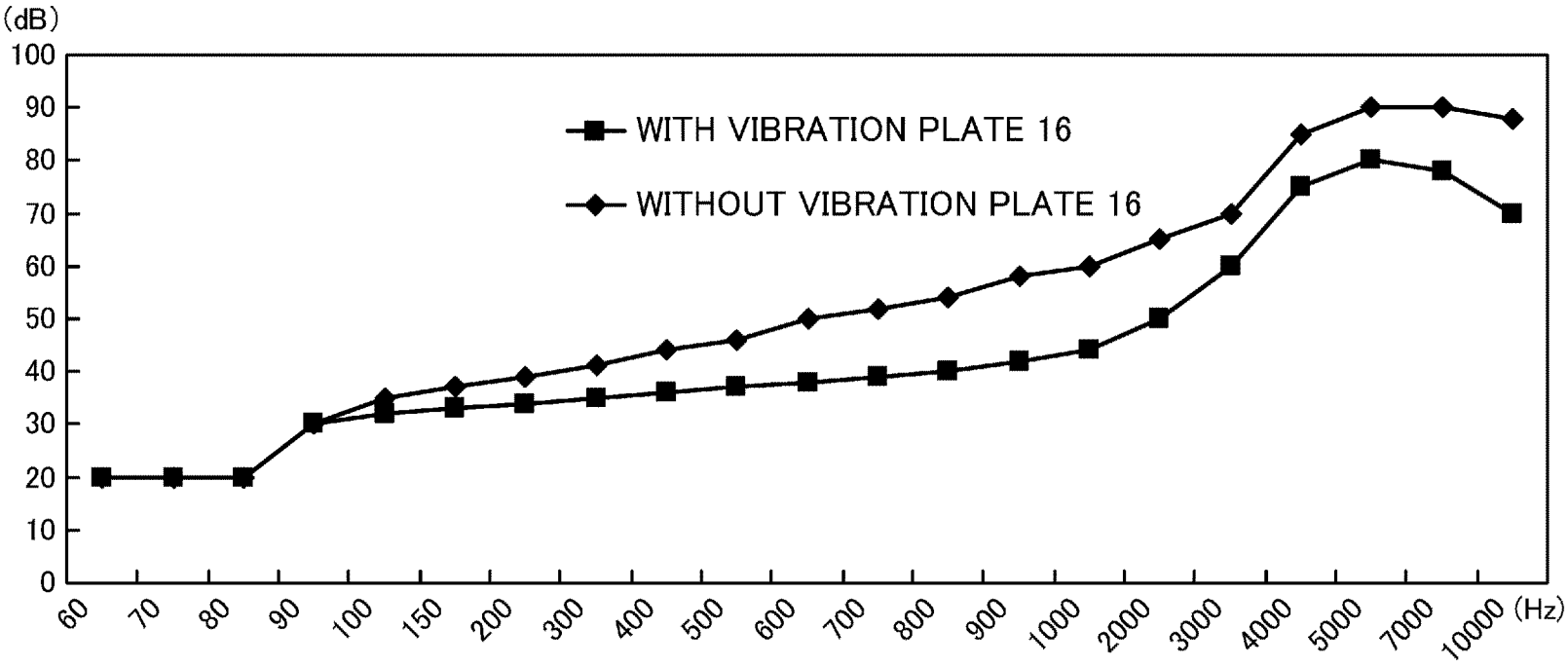
FIG. 11 shows frequency characteristics of leakage sound of the bone conduction speaker shown in FIG. 4 in both cases where the vibration plate is and is not provided.

FIG. 11 shows frequency characteristics of leakage sound of the bone conduction speaker 3 shown in FIG. 4 in both cases where the vibration plate 16 is provided and where the vibration plate 16 is not provided. In FIG. 11, the vertical axis represents a sound pressure (dB), and the horizontal axis represents a frequency of vibration (Hz). As shown in FIG. 11, the bone conduction speaker 3 with the vibration plate 16 shown in FIG. 4 provides lower sound pressure than the comparative example without the vibration plate 16. In other words, sound leakage to the user's surroundings is reduced.

Accordingly, the present embodiment includes: the vibration driver 13 which generates mechanical vibrations and air vibrations from sound signals; the first elastic member 12 which converts the air vibrations generated by the vibration driver 13 into mechanical vibrations; and the second elastic member 14 which is positioned to touch the vibration driver 13, and transmits the mechanical vibrations generated by the vibration driver 13 and the mechanical vibrations transmitted from the first elastic member 12, to the user.

The first elastic member 12 converts the air vibrations generated by the vibration driver 13 into mechanical vibrations, and the mechanical vibrations are transmitted to the second elastic member 14 which touches the first elastic member 12. The second elastic member 14 transmits the mechanical vibrations transmitted from the first elastic member 12 and the mechanical vibrations transmitted directly from the vibration driver 13, to the user. The quality of sound in the high frequencies is improved as a result of emphasizing the high frequency vibrations. Thus, for example, a user on a bicycle can enjoy music, while being aware of environmental sound by listening through his or her ears. Moreover, sound leakage is reduced because the hole 17 of the second housing 11 is closed by the first elastic member 12. Vibrations of the signal wires 18 drawn out from the vibration driver 13 are reduced because the signal wires 18 are sandwiched between the first elastic member 12 and the second elastic member 14, and therefore, the sound leakage through the signal wires 18 is also reduced.

The vibration driver 13 can be comprised of the coil 27 to which sound signals are transmitted, the magnet 24 which generates mechanical vibrations in reaction to the coil 27, and the diaphragm 26 which vibrates together with the coil 27 in reaction to the magnet 24, and thereby generates air vibrations.

The vibration plate 16 closing the opening of the vibration driver 13 converts the air vibrations generated by the vibration driver 13 into mechanical vibrations. The first elastic member 12 and the second elastic member 14 transmit low frequency vibrations generated by the vibration driver 13 and high frequency vibrations converted by the vibration plate 16, to the user. The quality of sound in the high frequencies is improved as a result of emphasizing the high frequency vibrations. Moreover, sound leakage, which may be annoying for those near the user, can be reduced by closing the opening of the vibration driver 13 by the vibration plate 16.

Other Embodiments

As described above, the first embodiment has been described as an example technique disclosed in the present application. However, the techniques according to the present disclosure are not limited to this embodiment, but are also applicable to those where modifications, substitutions, additions, and omissions are made. In addition, elements described in the first embodiment may be combined to provide a different embodiment.

Now, other embodiments will be described below.

In the first embodiment, part of the first elastic member 12 touches the vibration driver 13 and the second elastic member 14, but the position of the first elastic member 12 is not limited to this position. The first elastic member 12 may be positioned to touch only one or both of the vibration driver 13 and the second elastic member 14.

Figure 12:
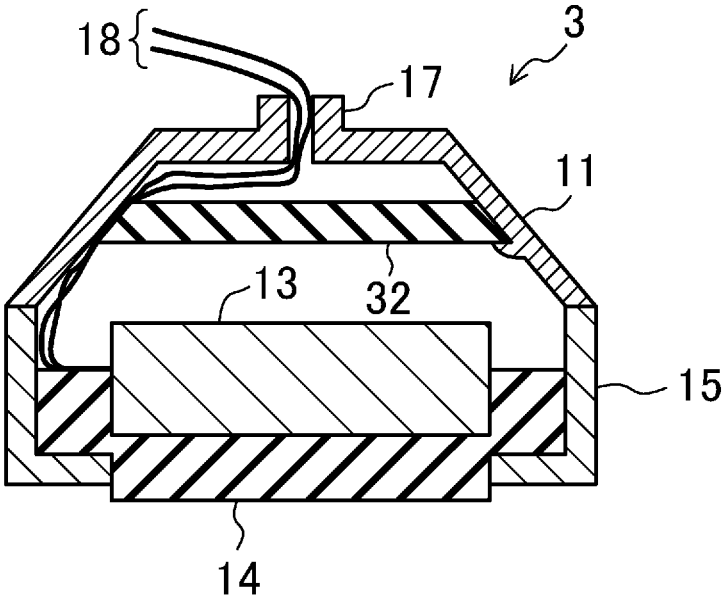
FIG. 12 is a cross sectional view illustrating inner configurations of a bone conduction speaker according to another embodiment.
Figure 13:
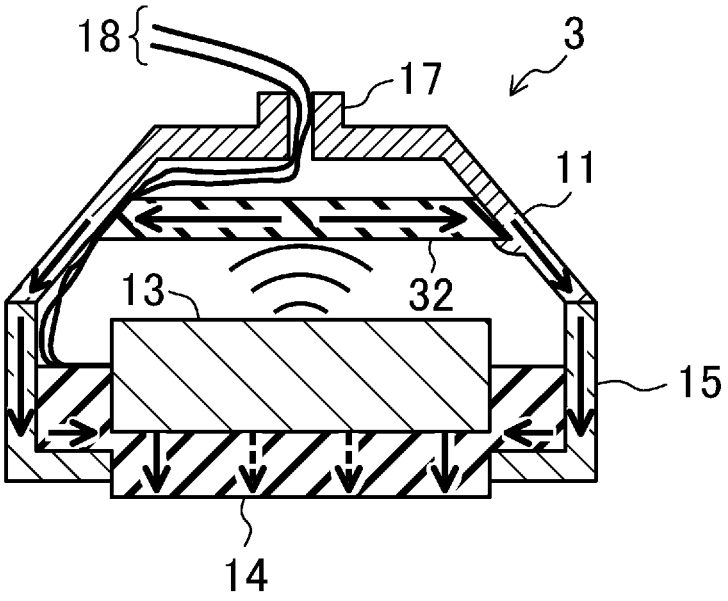
FIG. 13 illustrates how the bone conduction speaker shown in FIG. 12 works.

FIG. 12 is a cross sectional view illustrating inner configurations of a bone conduction speaker 3 according to another embodiment. FIG. 13 illustrates how the bone conduction speaker 3 shown in FIG. 12 works. In this embodiment, as well, it is possible to provide the vibration plate 16 which closes the opening of the vibration driver 13 (see FIG. 4).

As shown in FIG. 12, a first elastic member 32 does not touch the vibration driver 13 and the second elastic member 14, but is arranged such that the first elastic member 32 closes the hole 17 of the second housing 11, and that the signal wires 18 are sandwiched between the second housing 11 and the first elastic member 32. In this configuration, as shown in FIG. 13, the air vibrations generated by the vibration driver 13 are converted into mechanical vibrations by the first elastic member 32, and are transmitted to the second housing 11. The mechanical vibrations transmitted to the second housing 11 are transmitted to the second elastic member 14 via the first housing 15.

Thus, the air vibrations generated by the vibration driver 13 are not transmitted to the outside through the hole 17 of the second housing 11. In other words, sound leakage of the bone conduction speaker 3 and the bone conduction headphone device 1 is reduced. Further, vibrations of the signal wires 18 drawn out from the vibration driver 13 are reduced because the signal wires 18 are sandwiched between the first elastic member 32 and the second housing 11, and therefore, the sound leakage through the signal wires 18 is also reduced.

An acrylic board is used in the above description as an example of the vibration plate 16. Using an acrylic board as the vibration plate 16 can reduce the cost. However, the vibration plate 16 is not limited to the acrylic board. For example, a metal, e.g., an aluminum plate, may be used as the vibration plate 16. Frequencies of vibrations differ according to the material to use and the thickness thereof. Thus, the material and the thickness may be decided according to frequencies required.

Rubber is used as the first elastic members 12 and 32 and the second elastic member 14. However, the material for the elastic members 12, 14 and 32 is not limited to rubber. For example, the elastic members 12, 14 and 32 may be made of foam polystyrene.

In the bone conduction headphone device 1, the bone conduction speakers 3 are provided at both ends of the band 2, but the bone conduction speaker 3 may be provided at only one end of the band 2. In the case where the bone conduction speaker 3 is provided at only one end of the band 2, a pad may be provided at the other end, instead of bone conduction speaker 3. Further, the band 2 may have a shape which wraps around the user's head. Alternatively, the bone conduction headphone device 1 may be of an ear hook type without the band 2.

An electromagnetic vibration driver 13 is used in the above description, but the vibration driver 13 may be of various types, such as an electro-dynamic type, an electrostatic type, and a piezoelectric type.

The foregoing embodiments have been described as examples of the technique of the present disclosure. The attached drawings and the description are provided to show the examples.

Accordingly, the components shown in the attached drawings and the description may contain components unnecessary for solving the above-described problems as well as necessary components. Thus, the mere fact that such unnecessary components are shown in the attached drawings and the description should not address that these unnecessary components are necessary.

The foregoing embodiments are examples of the technique of the present disclosure, and thus, various modifications, substitutions, additions, and/or omissions, for example, may be made within the scope of the invention or its equivalent range as defined by the appended claims.

The present disclosure is applicable to bone conduction speakers and bone conduction headphone devices which require high frequency vibrations. Specifically, the present disclosure is applicable to mobile phones, smart phones, etc., with a music reproduction function.

What is claimed is:

1. A bone conduction speaker, comprising:

a vibration driver which generates mechanical vibrations and air vibrations from sound signals;

a first elastic member which converts the air vibrations generated by the vibration driver into mechanical vibrations; and a second elastic member which is positioned to touch the vibration driver and transmits the mechanical vibrations generated by the vibration driver and the mechanical vibrations transmitted from the first elastic member, to a user, wherein the first elastic member is positioned to touch the second elastic member, the first elastic member and the second elastic member cover an entire periphery of the vibration driver, and the vibration driver includes:

a coil to which the sound signals are transmitted;

a magnet which generates the mechanical vibrations in reaction to the coil; and a diaphragm which vibrates together with the coil in reaction to the magnet, and thereby generates the air vibrations.

2. The bone conduction speaker of claim 1, wherein the first elastic member and the second elastic member sandwich signal wires connected to the vibration driver.

3. A bone conduction headphone device, comprising:

a band; and the bone conduction speaker of claim 1 which is provided at at least one end of the band.

4. The bone conduction speaker of claim 1, wherein the first elastic member is arranged apart from the diaphragm.

5. The bone conduction speaker of claim 1, wherein the second elastic member is capable of being placed on a side head of the user to transmit the mechanical vibrations generated by the vibration driver and the mechanical vibrations transmitted from the first elastic member to the user.

6. A bone conduction speaker, comprising:

a vibration driver which generates mechanical vibrations and air vibrations from sound signals;

a first elastic member which converts the air vibrations generated by the vibration driver into mechanical vibrations; and a second elastic member which is positioned to touch the vibration driver and transmits the mechanical vibrations generated by the vibration driver and the mechanical vibrations transmitted from the first elastic member, to a user, wherein the first elastic member is positioned to touch the second elastic member, the first elastic member and the second elastic member cover an entire periphery of the vibration driver, and the bone conduction speaker further comprises:

a first housing with an opening; and a second housing coupled to the first housing, wherein the first elastic member, the vibration driver, and the second elastic member are located between the first housing and the second housing, and the second elastic member is exposed from the opening of the first housing.

7. The bone conduction speaker of claim 6, wherein the first elastic member, the second elastic member, the first housing, and the second housing are arranged to surround the vibration driver.

8. The bone conduction speaker of claim 7, wherein the first elastic member and the second housing sandwich signal wires connected to the vibration driver.

9. The bone conduction speaker of claim 6, wherein the second elastic member is capable of being placed on a side head of the user to transmit the mechanical vibrations generated by the vibration driver and the mechanical vibrations transmitted from the first elastic member to the user.

* * * * *